US005322293A

United States Patent [19]

Goyette

[11] Patent Number: 5,322,293

[45] Date of Patent: Jun. 21, 1994

[54] AUTO RACING GAME APPARATUS AND METHOD OF PLAY

[76] Inventor: Daniel A. Goyette, 22 Cooperfield Ave., Piedmont, S.C. 29673

[21] Appl. No.: 136,759

[22] Filed: Oct. 15, 1993

Related U.S. Application Data

[63] Continuation-in-part of application's design patent Application Serial No. 29/012,119, Aug. 23, 1993.

[51] Int. Cl.[5] ..... A63F 3/00

[52] U.S. Cl. ..... 273/246; 273/274

[58] Field of Search ..... 273/246, 249-254

[56] References Cited

U.S. PATENT DOCUMENTS

| | | | |
|---|---|---|---|
| D. 143,625 | 1/1946 | Reiff | D21/27 |
| D. 210,395 | 3/1968 | Royston | D21/27 |
| D. 307,922 | 5/1990 | Rose | D21/27 |
| 1,741,832 | 12/1929 | Farrell | 273/246 |
| 2,673,413 | 3/1954 | Weber | 283/48.1 |
| 3,044,779 | 7/1962 | Hvizdash | 273/246 |
| 3,119,616 | 1/1964 | Dopieralski | 283/48.1 |
| 3,212,780 | 10/1965 | Jewell | 283/48.1 |
| 3,462,152 | 8/1969 | Royston | 273/246 |
| 5,013,069 | 5/1991 | Hardin | 283/48.1 |
| 5,048,841 | 9/1991 | Manney et al. | 273/246 |
| 5,090,735 | 2/1992 | Meaney et al. | 283/67 |
| 5,094,451 | 3/1992 | Glamack | 273/32 H |
| 5,139,267 | 8/1992 | Trevisan | 273/246 |
| 5,181,743 | 1/1993 | Lloyd | 283/48.1 |

FOREIGN PATENT DOCUMENTS

| | | | |
|---|---|---|---|
| 1288071 | 9/1972 | United Kingdom | 273/246 |

*Primary Examiner*—Benjamin H. Layno
*Attorney, Agent, or Firm*—Richard C. Litman

[57] ABSTRACT

An auto racing board game includes a game board having a track layout with multiple lanes and overlapping lane spaces, with a starting line, victory lane and winner's circle. Player position markers (preferably resembling racing cars) are provided, with a lap chart/score sheet for each player and a series of lap and pit cards. Players choose position markers as desired, and the order of play is established by dice or the like, with the first player having the lowest number having the "pole position" at the starting line inside lane and other markers positioned accordingly. Play alternates among the players, with the quantity of each move being determined by the dice or other suitable device. Players can move their markers laterally to an adjacent lane space to attempt to achieve an advantage, and must draw lap cards periodically according to the lap chart/score sheet and pit cards when required to enter the pits according to the score sheet. The cards may provide some advantage or setback to the player drawing the card. Caution periods may occur according to cards drawn, which allow players to make up some portion of a multiple lap deficit, if any. Players completing a predetermined number of laps enter victory lane enroute to the winner's circle. While jumping other markers is not permitted during the race, such jumping is permitted on victory lane. A player must achieve the exact number required in order to land precisely in the winner's circle and win the game.

13 Claims, 3 Drawing Sheets

AUTO RACING GAME APPARATUS AND METHOD OF PLAY

REFERENCE TO RELATED APPLICATION

This application is a continuation in part of applicant's design patent application Serial No. 29/012,119, filed on Aug. 23, 1993.

FIELD OF THE INVENTION

The present invention relates generally to board games, and more specifically to a game including many of the factors involved in automobile racing. While the game is directed particularly to NASCAR (tm) type racing, it is adaptable to other types of automobile racing as well.

BACKGROUND OF THE INVENTION

Auto racing, particularly so called "stock car" racing, has become ever more popular as the rules have evolved to provide closer racing and more excitement for spectators. It is generally accepted that racing fans enjoy becoming involved in the activity to the greatest extent possible, whether by reading about racing, watching races on television, or actually attending an event in person. Many, if not most, racing fans are at least somewhat competitive by nature, and enjoy games and related activities which cater to that competitive urge, even if the vast majority cannot actually race themselves.

Accordingly, a few games and activities have been which cater to the automobile racing enthusiast. However, automobile racing in at least some of its variations is a family activity, and the games which have been developed tend to require some amount of knowledge or skill from a player, which results in many younger players without such knowledge or skill quickly becoming bored when they realize they have no chance of winning. Moreover, for those fans and families who actually attend a event in person, much time is usually spread over a few days between various events leading up to the final event. Racing fans, particularly families with children, must come up with between race activities which may be enjoyed casually, without need for sophisticated knowledge or skills and which require no deep involvement but may be enjoyed casually and yet provide some degree of competition and which relate to the racing sport.

The need arises for a board game simulating automobile racing, which game requires a minimum amount of equipment, knowledge and skill on the part of the players thereof. The game should be relatively simple to play, allowing even the youngest and least experienced of players to enjoy it, while at the same time simulating many of the situations which occur in auto racing.

DESCRIPTION OF THE PRIOR ART

U.S. Pat. No. 2,673,413 issued to Ralph R. Weber on Mar. 30, 1954 discloses a Score Card providing a means for the keeping of average scores over the course of several games. The device is particularly suited for bowling scores, but is adaptable to other numerical averages. The Weber score card with its averaging is not seen to be adaptable to the present game.

U.S. Pat. No. 3,044,779 issued to Joseph L. Hvizdash on Jul. 17, 1962 discloses a Game including a board simulating an oval race track. The track depicted on the board includes certain fixed advantages or penalties, which are always negotiated at the same places on the board during the course of play. The track contains several lanes, each containing the same number of spaces, unlike the variable spacing in the lanes of the present invention.

U.S. Pat. No. 3,119,616 issued to Edmund L. Dopieralski on Jan. 28, 1964 discloses a Bowling Score Sheet with Slides For The Recording Of Composite Scores. The device provides for the transferring of scores of certain frames between different competing bowlers, to even the score to a certain extent. No relationship is seen to the lap chart type score sheet of present game.

U.S. Pat. No. 3,212,780 issued to James E. Jewell on Oct. 19, 1965 discloses a Score Matching Control Card for bowling, in which a predetermined number is exposed and the bowler attempts to match that score. The scoring system bears no resemblance to the lap chart score sheet of the game of the present invention.

U.S. Pat. No. 5,013,069 issued to James D. Hardin on May 7, 1991 discloses a Golf Scorecard providing numerous variations in scoring for various versions of the game of golf. The scorecard is not adaptable for use in the play of the present game, as no provision is made for counting laps and/or other contingencies associated with auto racing.

U.S. Pat. No. 5,090,735 issued to Stacey B. Meaney et al. on Feb. 25, 1992 discloses a Seasonal Game providing a means of keeping score for a running baseball or football pool. The game bears no resemblance to the present auto racing board game.

U.S. Pat. No. 5,094,451 issued to Mark G. Glamack on Mar. 10, 1992 discloses a Combination Golf Score Recording Form And Yardage Map Guide. The device must be specially formed for each different golf course and cannot provide for use as a simulated lap chart for an auto racing game.

U.S. Pat. No. 5,139,267 issued to Richard S. Trevisan on Aug. 18, 1992 discloses a Method Of Playing A Racing Game in which player markers are advanced according to a spinner, and an intermediate step requires each player to draw a chip which is placed upon the board before the player position marker is so placed. A question must then be answered correctly before the chip can be removed and the player's position marker placed. The track depicted on the board includes the same differences noted in the discussion of the Hvizdash patent above, i. e., identically spaced lanes and reward/penalty spaces marked upon the board, thereby insuring that a player will always encounter the same situation at a given point on the track. The requirement to answer questions correctly demands some knowledge from the players, thus placing younger and/or less knowledgeable players at a disadvantage.

U.S. Pat. No. 5,181,743 issued to Christopher Lloyd on Jan. 26, 1993 discloses a Drug Information Request System providing for the transmittal of information according to certain boxes checked off on the form. The form is unsuitable for use as a lap chart or score sheet for use with the present game.

U.S. Pat. No. D-143,625 issued to Earl J. Reiff on Jan. 22, 1946 discloses a Game Board design for a horse racing game. The oval track includes a plurality of lanes, but each of the lanes contains the same number of spaces, unlike the present invention, and no pit lane(s), victory lane, or winner's circle is provided; the board cannot be used for the play of the present game.

U.S. Pat. No. D-210,395 issued to William C. Royston on Mar. 5, 1968 discloses a Gameboard design having an oval track and plural lanes thereon. Each of the lane straights contains the same number of spaces, unlike the present game board.

Finally, U.S. Pat. No. D-307,922 issued to Dana C. Rose on May 15, 1990 discloses a Game Board design having a squared oval track with plural lanes. Each of the lanes contains the same number of spaces and variously spaced indicia are distributed thereon, unlike the game board of the present game.

None of the above noted patents, taken either singly or in combination, are seen to disclose the specific arrangement of concepts disclosed by the present invention.

SUMMARY OF THE INVENTION

By the present invention, an improved auto racing game is disclosed.

Accordingly, one of the objects of the present invention is to provide an improved auto racing game which includes a game board simulating an oval auto racing track having plural lanes thereon.

Another of the objects of the present invention is to provide an improved auto racing game which game board provides for staggered positioning and differential spacing of each of the spaces forming each of the lanes at all points around the track.

Yet another of the objects of the present invention is to provide an improved auto racing game which game board includes a pit lane, a victory lane, and a winner's circle.

Still another of the objects of the present invention is to provide an improved auto racing game which provides for advancement of player position markers solely by chance means, thus providing unskilled players and/or players lacking knowledge in the field an equal chance of winning the game.

A further object of the present invention is to provide an improved auto racing game which includes means enabling players who have fallen behind, to make up at least some of the difference between their position and that of the position leader of the game.

An additional object of the present invention is to provide an improved auto racing game which includes further chance means comprising the random drawing of lap cards and pit cards by each player at specific points in the game, depending upon the number of laps completed by each individual player.

Another object of the present invention is to provide an improved auto racing game including a plurality of lap cards and a plurality of pit cards, which lap cards and pit cards contain specific instructions providing for the additional advance or loss of turn of a player drawing such a lap card or pit card.

Yet another object of the present invention is to provide an improved auto racing game including score sheets resembling auto racing lap charts, and which sheets are used in a similar manner.

Still another object of the present invention is to provide an improved auto racing game which includes player position markers resembling racing cars.

A final object of the present invention is to provide an improved auto racing game for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout the several FIGURES of the attached drawings.

DETAILED DESCRIPTION OF THE PREFERRED EMBODIMENT

Figure 1:
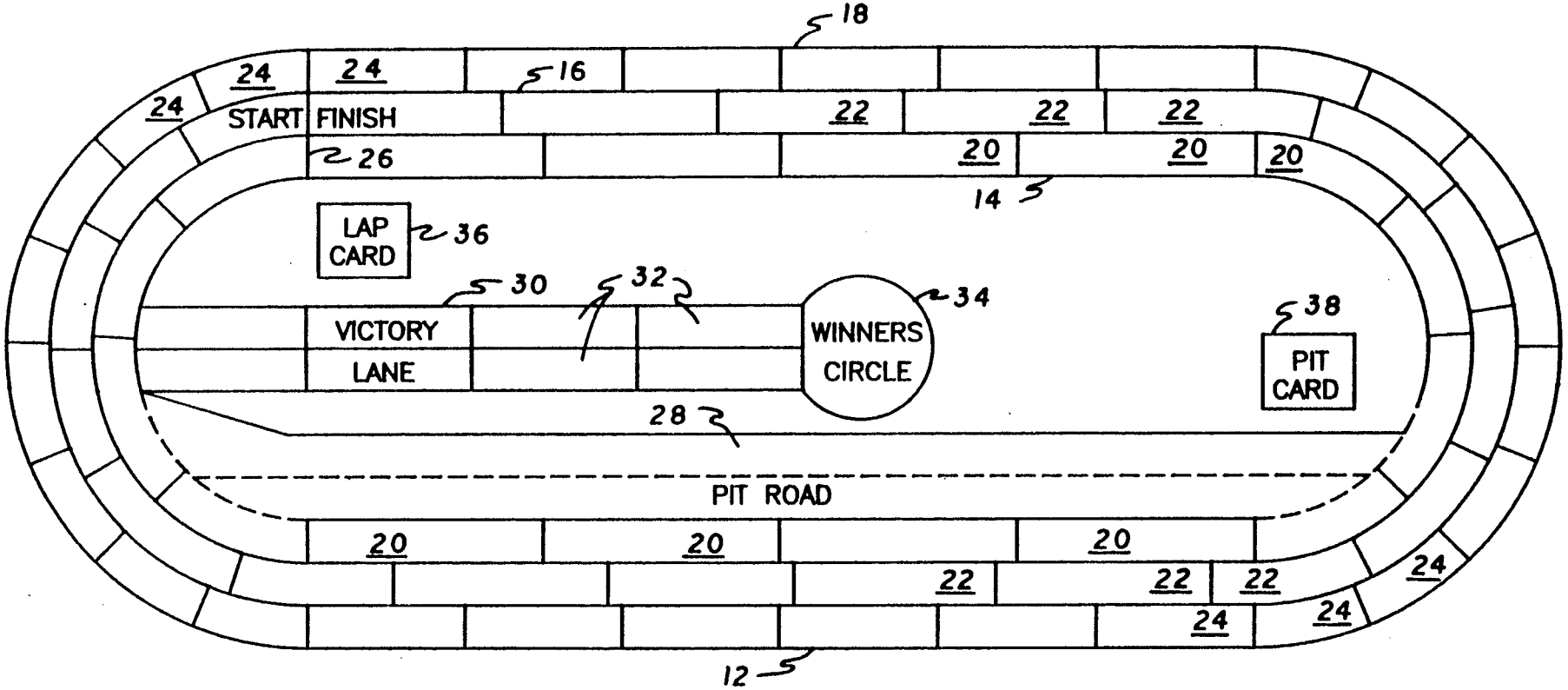
FIG. 1 is a plan view of the game board of the present invention, disclosing an auto race track layout for the play of the present game.

Referring now particularly to FIG. 1 of the drawings, the present invention will be seen to relate to an auto racing board game using the game board 10 of FIG. 1. The game board 10 of FIG. 1 includes a track 12, configured as an oval in the disclosed embodiment However, it will be understood that other track configurations (e.g., rectangular and having four turns or corners, "tri-oval," and/or road or street courses having a relatively complex configuration) may be used for the play of the present game also, just as auto racing events may take place on tracks having various configurations.

The track 12 will be seen to include a plurality of concentric lanes , including an inner lane 14, at least one intermediate lane 16, and an outer lane 18. The inner lane 14 includes a series of relatively long inner lane spaces 20, with the intermediate lane 16 containing a larger number of somewhat shorter intermediate lane spaces 22 and the outer lane 18 having an even larger number of shorter outer lane spaces 24. The precise number of spaces 20 through 24 is not critical to the play of the present game, so long as there are a sufficient number in each of the lanes 14 through 18 to require plural plays to complete one lap of the track 12. What is important, is that the inner lane 14 have fewer spaces 20 than the intermediate lane(s) 16, and that the intermediate lane(s) 16 have fewer spaces 22 than the outer lane 18. This configuration adds realism to the present game, by allowing a player whose position marker is on one of the inner lane spaces 20 to travel more quickly around the track 10 than players whose position markers are on the intermediate or outer lanes 16 and 18, as occurs in actual auto racing, at least in the center of the turns.

It will also be noted that the various inner lane spaces 20, intermediate lane spaces 22, and outer lane spaces 24 are staggered, with at least a small portion of their lateral limits contacting one another at every position around the track 12 with the exception of the start/finish line 26. This allows the player position markers to move laterally to an adjacent lane having at least some contiguous boundary, as will be described further below in the discussion of the play of the present game.

The game board 10 also includes at least one pit lane/road 28, and a victory lane(s) 30 comprising a series of victory lane spaces 32 leading to a winner's circle 34. These areas 28–34 enter into the play of the present game as will be described further below. In addition to the various areas 12 through 34 described above and resembling an auto race track, a lap card space 36 and a pit card space 38 are provided for a plurality of lap cards 40 (FIG. 3A) and pit cards 42 (FIG. 3B), described further below.

Figure 2:
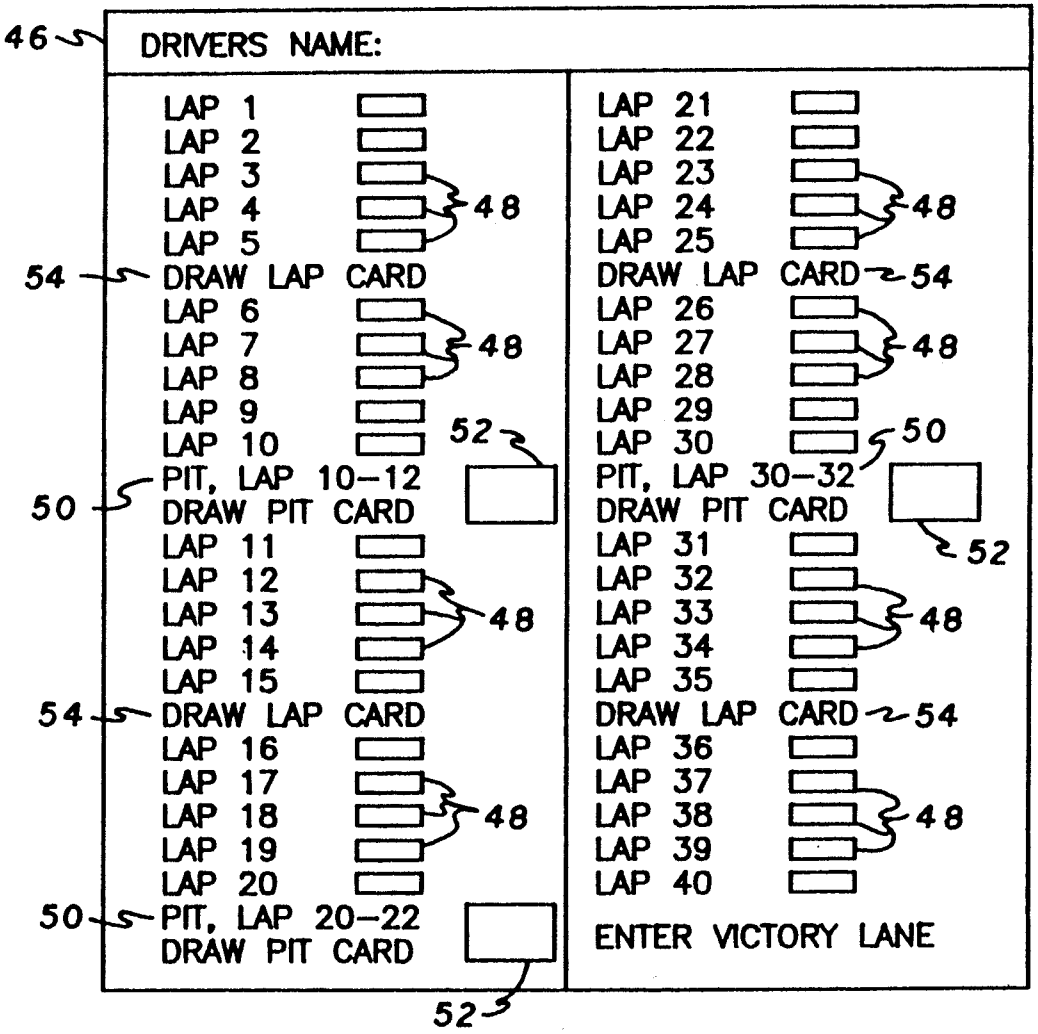
FIG. 2 is a plan view of a lap chart or score sheet for use in keeping score during the play of the present game.

FIG. 2 discloses a score sheet 44 used in the play of the present game. The score sheet 44 is similar to a lap chart used in auto racing to keep track of the position and laps completed by a given car. Accordingly, each player of the present game is provided with his/her own score sheet 44 for the game, with each score sheet 44 having a space 46 for entering an individual player's name (under "Driver's Name"). The lap chart 44 further includes a series of places 48 providing for the marking of completed laps as they occur, one or more instructions 50 to enter the pit lane(s) and draw a pit card 42 following the completion of a given number of laps (and spaces 52 to mark off the completion of such pit stops), and one or more further instructions 54 to draw a lap card 40 following the completion of a number of laps.

The above discussed score sheet or lap chart 44 for the present game also includes instructions 56 to enter victory lane 30, after the completion of a predetermined number of laps. However, it will be noted that no further instructions are provided thereafter. This is because no further stops or drawing of cards are required once the player position marker(s) has/have entered victory lane 30. The present game continues to provide for competitive action between players on victory lane 30, but the method of play changes somewhat in that part of the game, as will be described further below. It should be noted that while the lap chart/score sheet 44 of the present game provides for a total of forty laps, the drawing of a lap card 40 every five laps between pit stops, and the requirement for a pit stop and drawing of a card 42 approximately every ten laps, that the lap chart/score sheet 44 may be modified as desired to provide for more or fewer total laps per race or game, and more or fewer laps between instructions to draw a lap card 40 and to enter the pits and draw a pit card 42. The basic apparatus and rules of play are essentially identical, no matter the specific number of laps provided. In fact, the present game may also be played to a predetermined time limit, if time is critical, with the leader at the end of that time being the winner of the game.

Figure 3B:
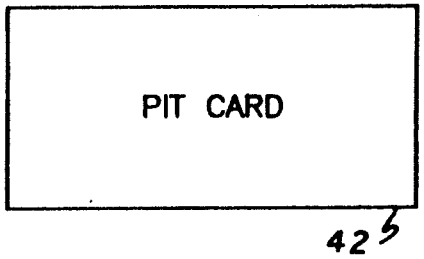
FIG. 3B is a back view of a pit card containing instructions to a player drawing such card during a pit stop as required from time to time during the play of the present game.
Figure 3A:
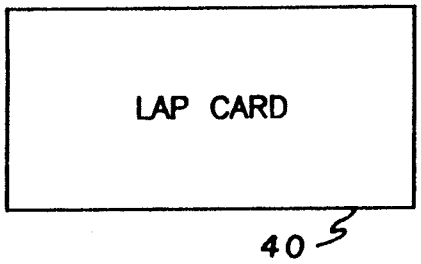
FIG. 3A is a back view of a lap card containing instructions to a player drawing such card during the play of the game.

FIGS. 3A and 3B respectively show the back faces of a lap card 40 and a pit card 42. A plurality of each of these cards 40 and 42 is provided, with instructions affecting the position of a player drawing a card 40 or 42. One lap card 40 is drawn by a player after completing a predetermined number of laps, and one pit card 42 is drawn when a player enters the pit road 28. The content of these cards 40 and 42 are disclosed in the following table:

| LAP CARDS | PIT CARDS |
|---|---|
| Slow lap speed | Slow pit stop |

-continued

| LAP CARDS | PIT CARDS |
|---|---|
| Move ahead one space | Lose another turn |
| Good lap speed | Slow pit stop |
| Move ahead two spaces | Add one space to count when leaving pits |
| Good lap speed | Slow pit stop |
| Move ahead three spaces | Add two spaces to count when leaving pits |
| Good lap speed | Slow pit stop |
| Move ahead four spaces | Add three spaces to count when leaving pits |
| Excellent lap speed | Average pit stop |
| Move ahead five spaces | Add four spaces to count when leaving pits |
| Tire going flat | Average pit stop |
| Enter pits to change tires | Add five spaces to count when leaving pits |
| Running out of fuel | Average pit stop |
| Enter pits to fill up | Add six spaces to count when leaving pits |
| Spun out, hit the wall | Average pit stop |
| Yellow flag out | Add seven spaces to count when leaving pits |
| Lose one turn | Good pit stop |
| Spun out, hit the wall | Add eight spaces to count when leaving pits |
| Yellow flag out | Good pit stop |
| Lose two turns | Add nine spaces to count when leaving pits |
| You blew your engine; | Great pit stop |
| You are out of the race | Add ten spaces to count when leaving pits |

The number of each of the above cards 40 and 42 may be varied as desired. However, preferably those cards 40 and 42 containing either extremely advantageous instructions (e.g., advancing ten additional spaces) or extremely unfortunate circumstances (e.g. being forced out of the game due to a "blown engine") will be relatively rare in each group of cards, perhaps numbering only one or two, while other specific cards are more numerous.

Figure 4:
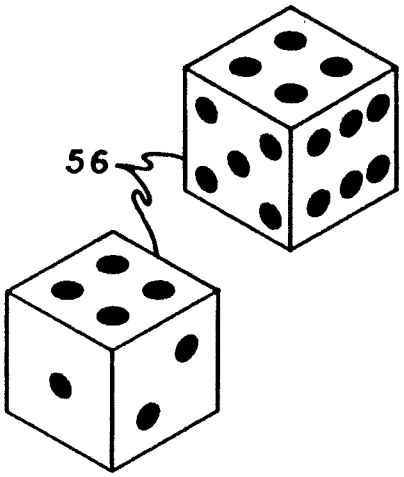
FIG. 4 is a perspective view of one form of chance means which may be used in the play of the present game.

FIG. 4 is a perspective view of a pair of standard dice 56, each having dots representing the numbers from one to six on their various respective faces. Such dice 56 may be used to provide the chance means required for the play of the present game, or alternatively other means may be used (e.g., spinner, drawing of numerically valued cards, etc.).

Figure 5:
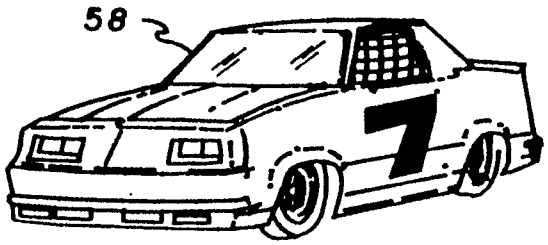
FIG. 5 is a perspective view of a player position marker for use in the play of the present game.

A typical player position marker 58 is shown in FIG. 5. The marker 58 represents an automobile, specifically one having an appearance somewhat like a NASCAR (tm) "stock car." Preferably, a series of such markers 58 is provided, with each of the markers 58 having a different color scheme and number to represent specific actual racing cars. Other player position markers (perhaps not even representing any type of automobile) may be used in the play of the present game, but the use of such markers 58 representing a racing car is preferable and adds to the spirit of the game.

The present game is played by allowing the various players to choose the particular player position marker 58 they wish to use in the game. In the case of two or more players wishing to use a specific marker, the chance means may be used to settle the matter. Each player rolls the dice 56 (or uses other chance means provided) to "qualify" and determine their respective starting positions and order of play. As the lowest elapsed qualifying time is used to determine the "pole position" (i. e., the space closest to the starting line at the inside lane of the track) in auto racing, so the player achieving the lowest number with the chance means is "on the pole." The player achieving the next best score takes the first space in the intermediate lane 16, and the next player takes the first outer lane 18 space, with subsequent players aligning their markers 58 in the same order behind the first spaces.

Play is begun by the first player rolling the dice 56 or using other chance means to determine the number of spaces for his/her move. The first player's position marker 58 is moved accordingly. The next player having the starting position closest to the starting line 26 in the intermediate lane 16 moves next, and so on, with play continuing in order through each of the players before returning to the first player. However, there is no requirement that any of the players remain in the lane 14 through 18 in which they started. The present game allows any of the players to switch lanes as desired, and in accordance with the fewer spaces 20 of the innermost lane 14, it will be seen that a good tactic is to move to that lane 14 as soon as possible after the start. Such a lane change counts as one space change for the player making the move. For example, a player rolling a total of eight with the dice 56, may move one space inward (or outward, if desired) and seven spaces forward. Such lateral moves are necessary at times, as the player position markers 58 may not be moved directly over one another during the course of play around the track 12. As can be seen, it may be possible to set up certain tactics to cause another player to take a longer route around another marker 58, thus delaying that player slightly, just as is done in actual auto racing on occasion.

As each of the players completes a lap of the track 12, the player (or a "commissioner" designated by the players) marks off the completed lap in the appropriate space 48 of the lap chart/score sheet 44. When a player has completed a predetermined number of laps (e.g., five, in the exemplary score sheet 44 of FIG. 2), that player must draw a lap card 40 from the stack of such cards positioned at 36 on the board 10, and respond according to the instructions disclosed in the table above for that card 40.

The card 40 may allow the player to move ahead an additional number of spaces, or alternatively may require the player to enter the pit lane(s) 28; the player may take up to two laps to do so if desired. (A player attempting to stay on the track 12 for more than two laps after being instructed to enter the pits 28, automatically loses two turns.) This is a disadvantage, as any time a player enters the pit lane(s) 28, that player loses at least one turn, similarly to actual auto racing wherein speeds are slowed and time is taken for service to the car in the pits. Depending upon the particular instruction of the card 40 drawn, a player may be required to lose up to two turns (e.g., "Spun out, hit the wall, lose two turns, yellow out"), or in the worst possible case, may be forced out of the game due to a "blown engine."

Oftentimes in actual racing, a caution period permits a car to make up nearly a full lap by catching up to the slower traffic during the caution period. By passing the lead car when racing begins again (a "green flag" situation), the driver is in an excellent position to gain yet another lap in the event of another caution period. The present game provides a similar advantage to players who have fallen two or more laps behind for whatever reason. In the event that a card 40 is drawn which notes that a yellow flag is out (designating a caution period), players who are two or more laps behind are allowed to mark off an additional lap on their score sheets 44, thus in effect "making up" one lap. This has the effect of keeping the competition closer, just as is done in actual auto racing. However, a player who is only one lap behind the leader receives no such advantage, as to do so might place that player in the lead while the leader is obliged to lose one turn in the pits.

Periodically during the course of the game, each player is required to enter the pit lane(s) 28. The exemplary score card 44 of FIG. 2 provides for such at laps 10, 20, and 30, with a two lap "window" (e.g., laps 10 to 12) allowed for such a pit stop. Whenever a player enters the pit lane(s) 28, he/she automatically loses one turn, as discussed above. In addition, the player must draw a pit card 42 and respond according to the instructions thereon as listed in the table. Such instructions may be advantageous, e.g., adding one or more spaces to the count when leaving the pits, or disadvantageous, e.g., causing the player to lose an additional turn, depending upon the pit card 42 drawn. The "blocking" tactic mentioned above can prove advantageous to players on the track 12, if they are able to position their markers at the entrance or exit to the pit lane(s) 28 as another player is entering or departing the pit lane(s). This depends greatly upon the spaces to be moved by the players according to the chance means, but judicious maneuvering to and from adjacent lanes may allow such a tactic, which adds interest to the present game.

Play continues in the manner described above, with the players marking off their completed laps and drawing lap cards at the designated laps (e.g., 5, 15, 25, and 35, in the score sheet 44 of FIG. 2), entering the pit lane(s) 28 as instructed, and drawing pit cards 42 and responding to the instructions thereon as required. When a player(s) has/have completed the predetermined number of laps (e.g., 40, according to the score sheet 44 of FIG. 2), only a single die 56 is used and that player's marker 58 is maneuvered to enter victory lane 30. This will tend to "bunch up" the remaining players, as they will still be using both dice 56 until they complete the required number of laps.

It will be noted that, unlike an actual auto race, the present game is not over when the first player position marker 58 crosses the start/finish line 26 after completing the designated number of laps comprising the game. After completing the predetermined number of laps, the player(s) must continue to victory lane 30, as noted above. Preferably, at least two separate lanes 30 are provided, thus allowing at least two player position markers to rest beside one another in the victory lane area 30. In addition to being limited to a single die 56, a player must achieve the precise number required to move the remaining number of spaces 32 to arrive exactly in the winner's circle 34. As can be seen, a player(s) on victory lane may require several turns to achieve the precise number required, thus allowing player(s) further behind to catch up, and generally providing for an extremely close and suspenseful finish to the present game. An additional reason for the use of only a single die 56 will be seen, in that a player arriving only one space 32 away from the winner's circle 34, would be unable to achieve the required single space move using two dice. In order to allow a player further behind to have an equal chance at arriving in the winner's circle 34, passing over other player position markers 58 and the occupation of a single victory lane space 32 by two or more player position markers 58 is permitted, unlike the situation on the track 12 during the race or game.

The disclosure above will be seen to provide a game simulating auto racing which can be enjoyed by a wide variety of persons, whether knowledgeable about racing or not. The pure chance means for determining the moves of the players requires no skill; yet, certain tactics may be used in the movement of the position markers to gain advantage during play. The result is a game which may be played casually by race fans or others of virtually any age and level of skill or knowledge in racing, whether at a racing event or in the comfort of the home or other area.

It is to be understood that the present invention is not limited to the sole embodiment described above, but encompasses any and all embodiments within the scope of the following claims.

I claim:

1. A board game simulating auto racing, comprising:

a game board simulating an auto racing track with said track having a plurality of lanes comprising an inner lane, an outer lane, and at least one intermediate lane therebetween, with a start/finish line extending across said plurality of lanes;

said game board further including at least one pit lane, at least one victory lane, and a winner's circle;

a plurality of player position markers corresponding to the number of players of said board game;

a plurality of score sheets corresponding to the number of players of said board game; and a plurality of cards providing for the positional advance or loss of a turn of a player drawing one of said cards; and chance means providing for the advance of each of said player position markers about said lanes of said track, whereby;

said board game simulating auto racing is played by each of the players alternatingly advancing their respective said player position markers according to said chance means, each of said score sheets comprising indicia for maintaining a record of their number of laps completed and indicia corresponding to said plurality of cards for drawing one of said plurality of cards at certain intervals after a predetermined number of laps have been completed by said position markers, and playing accordingly while attempting to advance each of their said player position markers to complete a predetermined number of laps to advance to said winner's circle.

2. The auto racing game of claim 1 wherein:

each of said lanes includes a plurality of spaces thereon, with said outer lane containing more spaces than said at least one intermediate lane, and said at least one intermediate lane containing more spaces than said inner lane, and;

each of said spaces of each of said lanes having a staggered relationship to one another and at least partially overlapping each of said spaces disposed adjacent thereto around said game board, with the exception of said start/finish line.

3. The board game of claim 1 wherein:

said plurality of cards are comprised of a first group and a second group, with said first group comprising a plurality of lap cards providing instructions for players as the players complete a predetermined number of laps about said track, and said second group comprising a plurality of pit cards providing instructions for the players as the players periodically travel through said at least one pit lane during the course of play of said board game.

4. The board game of claim 1 wherein:

each of said score sheets includes a plurality of consecutively numbered lap spaces corresponding to the number of laps comprising the course of said board game, and further includes a plurality of spaced apart positions separated by a predetermined number of said lap spaces and providing for the drawing of one of said cards and for periodic travel in said at least one pit lane.

5. The board game of claim 1 wherein:

said chance means comprises a pair of dice.

6. The board game of claim 1 wherein:

each of said player position markers is configured to resemble a racing car.

7. A method of playing a board game simulating auto racing, comprising the following steps:

providing a game board simulating an auto racing track with the track having a plurality of lanes comprising an inner lane, an outer lane, at least one intermediate lane therebetween with each of the lanes including a plurality of spaces therealong and with a start/finish line extending across the plurality of lanes, at least one pit lane, at least one victory lane, and a winner's circle a plurality of player position markers corresponding to the number of players of the board game, a plurality of score sheets corresponding to the number of players of the board game, a plurality of lap cards and pit cards providing for the positional advance or loss of a turn of a player drawing one of the cards, and chance means providing for the advance of each of the player position markers about the lanes of the track;

selecting a player position marker for each player;

manipulating the chance means for each player and thereby determining the order of play for a first through subsequent players and the relative starting positions on the track for each player's player position marker;

alternatingly manipulating the chance means and placing each player's player position marker accordingly on an appropriate space upon the track, and marking each player's score sheet according to the number of laps completed;

drawing a lap card according to the score sheet whenever a predetermined number of laps have been completed by that player, and manipulating that player's position marker according to any instructions on the lap card;

drawing a pit card according to the score sheet whenever a predetermined number of laps have been completed by that player, and maneuvering that player's player position marker according to any instructions on the pit card;

continuing play in the above manner until at least one player has completed a predetermined number of laps;

advancing that player's player position marker along the victory lane of the playing board; and reaching the winner's circle of the playing board and thereby winning the game.

8. The method of play according to claim 7 including:

playing until reaching a predetermined time limit, with the player having the leading player position marker winning the game.

9. The method of play according to claim 7 including:

providing a track layout on the game board having a plurality of adjacent lanes with each of the lanes including a plurality of space therealong with adjacent spaces being staggered relative to one another and partially overlapping, and;

moving a player position marker laterally from one of the lanes to an adjacent lane of the track and thereby attempting to gain a positional advantage over any other player position markers on the track.

10. The method of play according to claim 7 including:

providing at least one lap card requiring a caution period, and enabling any player position markers more than two laps behind the lead player position marker to gain one lap on the lead player position marker during the caution period.

11. The method of play according to claim 7 including:

allowing one player position marker to pass over another player position marker when moving along the victory lane.

12. The method of play according to claim 7 including:

allowing one player position marker to reside in the same space as another player position marker when moving along the victory lane.

13. The method of play according to claim 7 including:

requiring a player to use the chance means to achieve the exact number required to arrive exactly in the winner's circle in order to win the game.

* * * * *